United States Patent [19]

Fischer

[11] 4,332,979

[45] Jun. 1, 1982

[54] ELECTRONIC ENVIRONMENTAL ACOUSTIC SIMULATOR

[76] Inventor: Mark L. Fischer, 555 Middlefield Rd., Apt. P206, Mountain View, Calif. 94040

[21] Appl. No.: 189,774

[22] Filed: Sep. 22, 1980

Related U.S. Application Data

[63] Continuation of Ser. No. 970,996, Dec. 19, 1978, abandoned.

[51] Int. Cl.[3] ..... H04R 5/00

[52] U.S. Cl. ..... 179/1 GQ

[58] Field of Search ..... 179/1 GQ, 1 GH, 1 G, 179/1 J, 1 AT; 84/1.01, 1.24, 1.27; 333/28 R, 28 T

[56] References Cited

U.S. PATENT DOCUMENTS

| | | | |
|---|---|---|---|
| 3,463,868 | 8/1969 | Laube | 179/1 J |
| 3,484,563 | 12/1969 | Tak | 179/1 J |
| 3,970,788 | 7/1976 | Cooper | 179/1 GQ |
| 4,039,755 | 8/1977 | Berkovitz | 179/1 J |
| 4,053,711 | 10/1977 | DeFreitas et al. | 179/1 J |
| 4,105,864 | 8/1978 | Berkovitz | 179/1 J |

OTHER PUBLICATIONS

Goldmark, P. et al., "Synthetic Reverberation", Proceedings of IRE, vol. 27, No. 12, Dec. 1939, pp. 747–752.

*Primary Examiner*—Errol A. Krass
*Assistant Examiner*—E. S. Kemeny
*Attorney, Agent, or Firm*—Bernard Stimler

[57] ABSTRACT

Systems analysis approach to measure and to reconstruct the sound energy flux distribution characteristic of "live" situations. The present invention relates to a method of measurement of acoustical fields and the functional relationships in audio systems for enhancing the reproduction of sound. The environmental acoustic simulator is a system which generates at least two signals having different combinations of time delays from each of a stereo input signal pair and for deriving therefrom a set of not less than four output channels. At least forty five time delays at nonuniform intervals spanning a time period of not less than two seconds with different frequency equalizations are derived. Diffuse sound fields are created through electronic mixing and by the employment of not less than four loudspeaker groups. The sound fields generated simulate the reverberation typically observed in an auditorium, concert hall or cathedral, without distasteful interaction, or distortions, and provides full dimension and realism to sound by increasing dimension through reflections and emphasizing harmonic relationships nonexistent at recording. This provides greater aesthetic enjoyment of recorded music.

3 Claims, 15 Drawing Figures

ELECTRONIC ENVIRONMENTAL ACOUSTIC SIMULATOR

This is a continuation of application Ser. No. 970,996, filed Dec. 19, 1978, now abandoned.

FIELD OF THE INVENTION

The invention takes the systems analysis approach to measure and to reconstruct the sound fields associated with the physical phenomena classified as environmental acoustics, namely it measures and recreates the ambiance and/or reverberation and/or harmonic structures and/or spatial distribution often associated with live performances in concert halls and the like. Sound fields generated in the typical auditorium or concert hall comprise the physical interaction of sound waves which characterize the acoustic property of location to the listener which can be measured and reconstructed electronically by analog or digital computer circuitry and suitable measuring instruments and audio componentry. The present invention relates to a method of measurement of acoustical fields and to the functional relationships in audio systems for enhancing the reproduction of sound from monophonic and stereophonic signals emanating from radios, phonographs, tape recorders and like devices and from other electrical signals emanating from musical instruments with output connections.

BACKGROUND OF THE INVENTION

Sound reproduction equipment still does not provide the full dimensionality and realism of the fine auditorium or concert hall, namely they do not fully increase the dimension capability of reproduction—reflections, as well as emphasizing harmonics. Many technical factors influence the sound of a concert hall: total reverberation time, the fading rate of the echoes, resonances, the absorptive and reflective properties of building materials, and the directional patterns of sound reflections are but the main considerations. This characterizes the acoustic property of location to the listener for which prior attempts to achieve have been made mainly in the recording process using phase shifting and increased high fidelity and other "surround sound" effects.

Recent attempts to recreate the sound field close to that which is heard at a live performance have merely delayed versions of the original signals and reproduced them through conventional speakers. The range of these reverberation delays have been quite short, typically approximating one second and the interval between reflections have not generally occurred at a large enough number of random times to produce a high density of echoes. One difficulty has been to create a reverberation system which has a relatively long reverberation time without having an undesirably long time between discrete echoes. To avoid the single echo effect, different cross-channel recycling loop techniques have also been used which produce audio output signals containing delayed signals which decay exponentially or logarithmically in amplitude.

Sound energy may be absorbed and reflected to a different degree by a particular material if the frequency of the incident wave varies. As the sound wave undergoes second, third and successive reflections, its spectral deviation from the original direct wave becomes greater since a spectral change occurs upon each reflection. Reinforcements and cancellations at different frequencies will also occur. The spectral content of the reflected wave will not retain the same relationship of the fundamental frequency of a sonic event with or among its harmonics. Successive reflections of a sonic event at some points in time may be louder at a listener's location than some or all of its predecessors arising from the same sonic event. Previously designed audio systems have not provided for these changing spectral relationships during decay, namely the subjective clarity characteristic of sharp transients and the mellowness associated with the relatively more rapid decrease of higher harmonics as opposed to the fundamental and lower harmonics of musical notes. Additionally, these systems show insufficient understanding of actual sound fields in auditoriums, concert halls and/or cathedrals, by restricting bandwidth, poorly choosing initial delays, by shortening the range of the maximum reverberation time achieved and by failing to consider the energy flux distribution as a function of the angle of incidence upon the listener. Satisfactory means to measure and characterize these relationships and to serve as design parameters and performance criteria for sound reproduction systems have not been developed sufficiently.

Many variations have been derived of the "matrix-type" four channel sound system, where four signals are generated. The front channel signals are identical or very similar to the conventional stereo signals. The rear channel signals are derived by obtaining a signal corresponding to the instantaneous voltage difference between the two stereo signals and remixing them with some portion of the front channels. To reproduce the signals, four conventional amplifiers drive respective loudspeaker systems. The use of only two additional channels have been obviously found inadequate to date partially explaining the multiplicity of competitive systems using variations in parameters. To encode and decode four channels independently have not been satisfactory. The rear speakers cannot possibly generate the diffuse sound field created by typical acoustic environments in auditoriums.

SUMMARY OF THE INVENTION

A primary aim and object of the present invention is to provide a system classified as an environmental acoustic simulator which generates at least two signals having different combinations of time delays from each of a stereo input signal pair and for deriving therefrom a set of not less than four output channels each applied to at least one individual loudspeaker. At least forty five (45) time delays at nonuniform intervals spanning a time period of not less than two (2) seconds with different frequency equalizations are derived there from a stereo input signal pair. The incoming stereo inputs are blended to an increasing degree as the time delay components become longer and thus further removed in time from the input signals. Diffuse sound fields are created through electronic mixing and by the employment of not less than four (4) loudspeaker groups each consisting of one or more loudspeakers. No group of speakers shall have electrical signals fed including time delay components comprising an exact subset of those fed to other speaker groups further forward or further rearward.

Another object is the provision of a sound reproducing system having outputs realistically simulating the reverberation typically observed in an auditorium, concert hall or cathedral, depending on the intermix and time delays, without attendant distasteful interaction or distortions and at reasonable cost.

A still further object is the provision of a sound reproducing system that can create a unique listening environment of improved character for recordings, tapes and the like and for electronic musical instruments.

Yet another object is the provision of the full dimensionality and realism of the fine auditorium or concert hall by increasing dimension through reflections and emphasizing harmonic relationships nonexistent at recording.

Another object is the provision of an entertainment device which could be used in a home in conjunction with a conventional high fidelity stereophonic sound system to add greater realism and attendant aesthetic enjoyment to recorded music.

An additional object is the provision of a method of measurement and measuring devices to characterize acoustic environments, establish design parameters and performance criteria for the aforementioned sound reproducing systems and devices and which will serve to indicate their performance when judged by said criteria.

DESCRIPTION OF THE DRAWINGS

The invention will be more fully understood from the following detailed description in which references may be had to the accompanying illustrative drawings, wherein:

FIG. 1 is a block diagram of a Test Measurement Setup for determining the acoustical relationships in auditoriums and the like;

DETAILED DESCRIPTION OF THE PREFERRED EMBODIMENT

The present invention contemplates a system for measuring and a related system for simulating the acoustics found in typical concert halls, auditoriums and the like. An audio signal, typically a stereo signal is the source for the system for recreation. The characterization of the acoustic property of location is achieved by successfully comparing the measured response of an array of critically arranged directional microphones after exciting a spherical array of loudspeakers in the environment to be measured with the results of the same experiments performed in an echoless environment. The recreation of the sound field is successfully achieved by an arrangement of electronic circuits and loudspeakers which transform the electrical input signal or signals in such manner and directs them at a listener with such spatial distribution as to be analogous to that which was measured.

Figure 1:
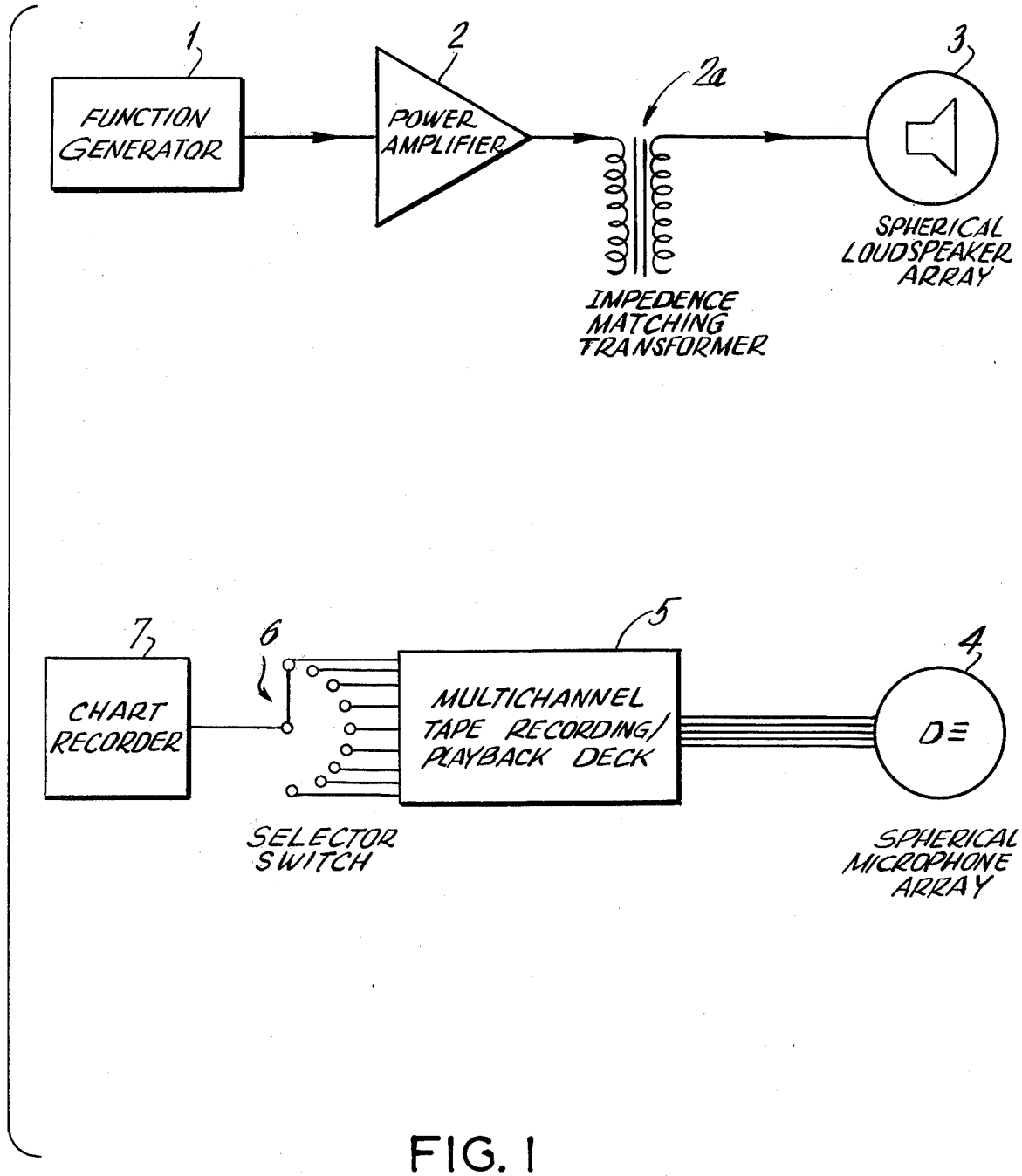

With reference to FIG. 1 there is shown in block diagram an implementation of the measurement concept. Function generator (1) feeds a brief pulse at any arbitrarily preselected audio frequency or a steady state sine wave at any arbitrarily preselected audio frequency which can be abruptly curtailed. Said signal is fed to power amplifier (2) and then to impedence matching transformer (2*a*) which excites spherical loudspeaker array (3). At some time later microphones in microphone array (4) are excited by the resultant acoustical energy waves creating outputs recorded independently on different tracks of multichannel tape recorder/playback deck (5). Playback of each track is selectively fed to chart recorder (7) by means of selector switch (6).

Figure 2:
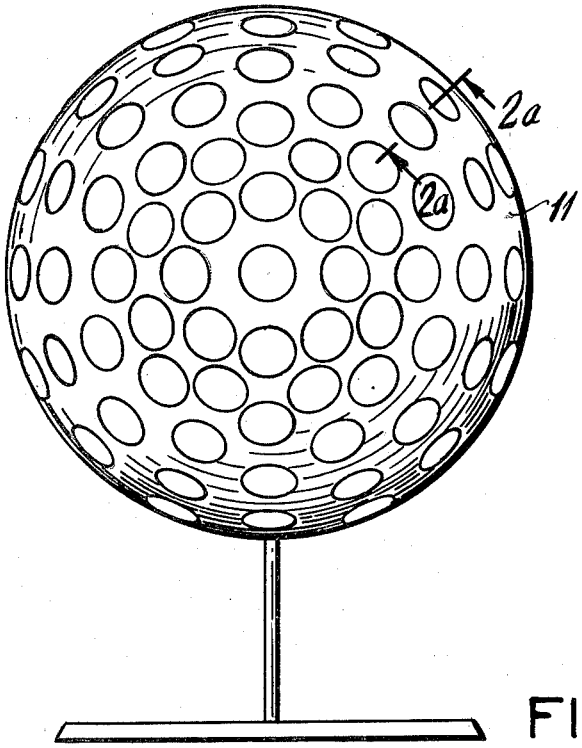
FIGS. 2 and 2*a* are a drawing of the Spherical Speaker Array.
Figure 2A:
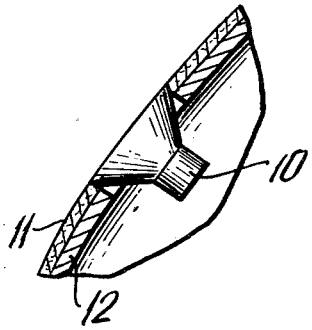

With reference to FIG. 2 there is shown a preferred embodiment of a spherical array of loudspeakers whose characteristic sound radiation pattern is essentially uniform in all directions. All loudspeaker drivers (10) are identical and wired in parallel to receive the same excitation. The construction of the spherical array of loudspeakers would include sound absorbing material (11) and baffles (12).

Figure 3:
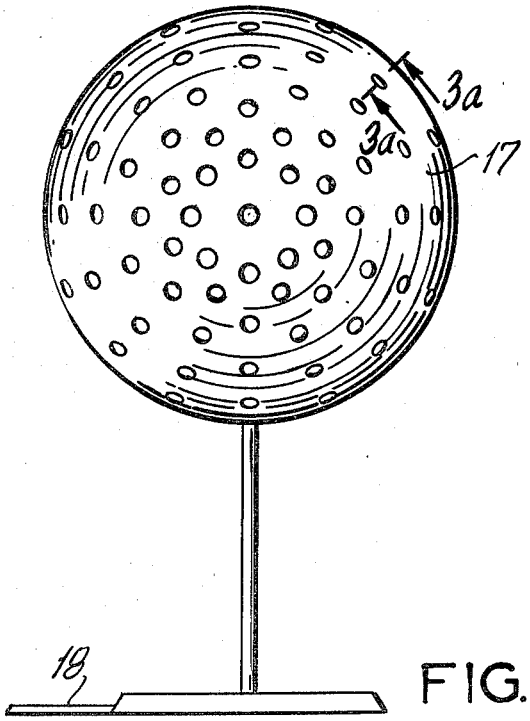
FIGS. 3 and 3*a* are a drawing of the Spherical Microphone Array.
Figure 3A:
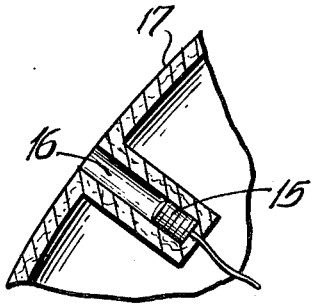

With reference to FIG. 3 there is shown a preferred embodiment of the spherical microphone array. The array is equally sensitive to the incidence of acoustic energy in all directions especially in its upper hemisphere by virtue of the uniformity of arrangement of identical unidirectional microphones. The microphone elements (15) are each placed in a sound orifice (16) surrounded by sound absorbing material (17). Each microphones electrical output is wired separately to be available for independent recording of its contribution to the totality of the measurement. The electrical outputs would be combined into multiconductors (18).

Figure 4:
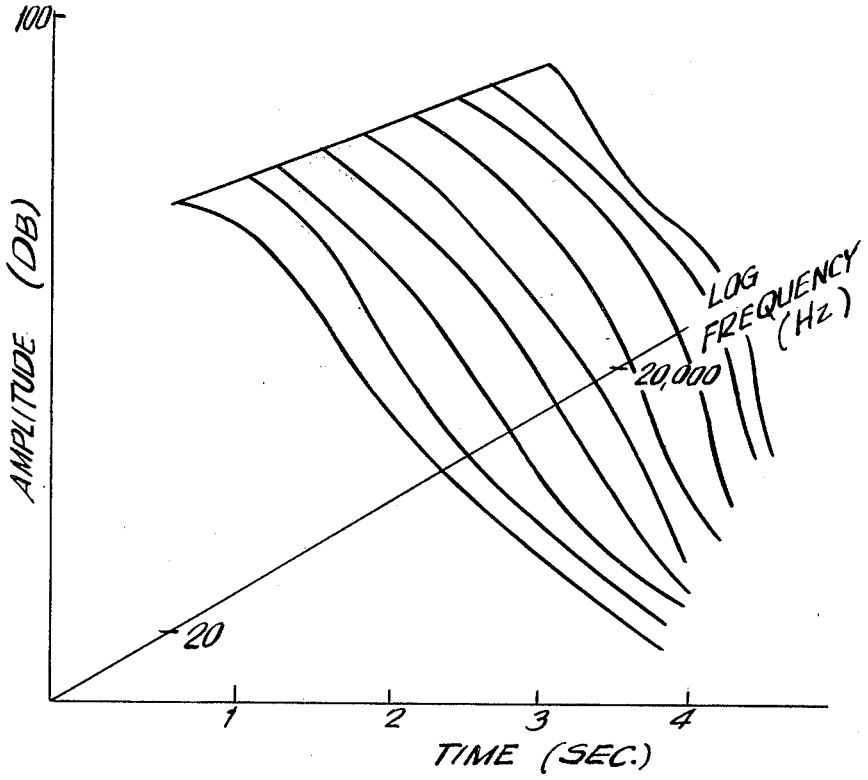
FIG. 4 is the Presentation of Data from A Single Microphone.

FIG. 4 indicates a presentation of the data expected from a single microphone typically showing the decay of sound amplitude over time, where the experimental procedure is repeated for different audio frequencies with the speaker array and microphone array kept at fixed locations.

Figure 5:
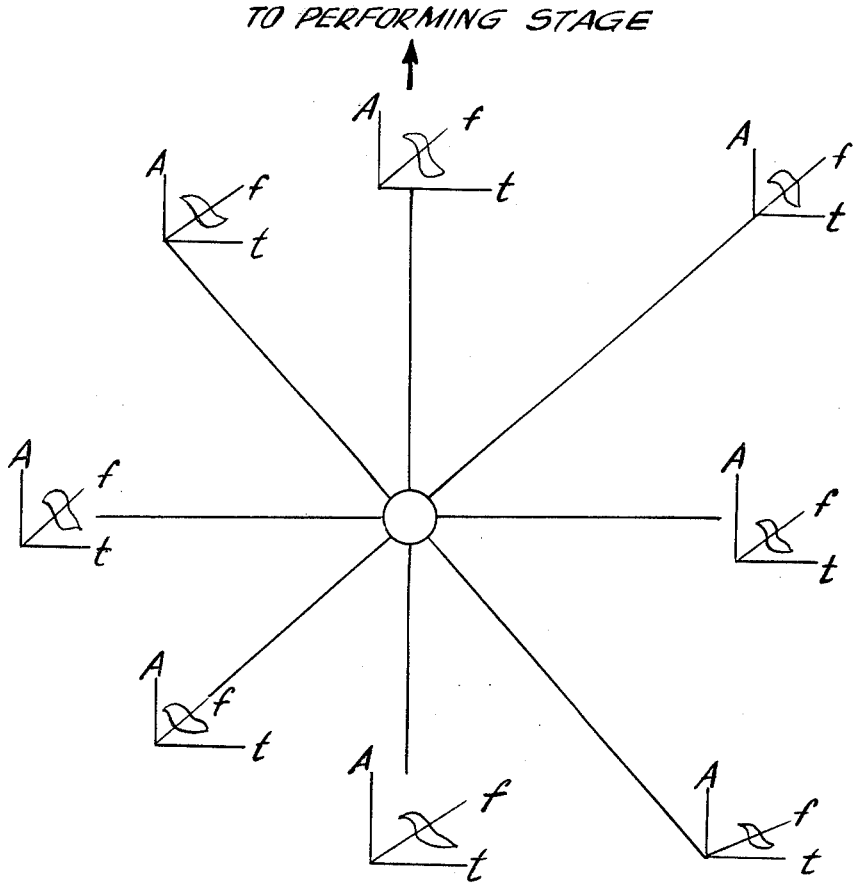
FIG. 5 is the Presentation of Data From Different Directions Corresponding to Different Microphone Pickups.

FIG. 5 indicates that a similar graph to that presented in FIG. 4 can be drawn for each direction corresponding to a microphone in the microphone array.

Figure 6A:
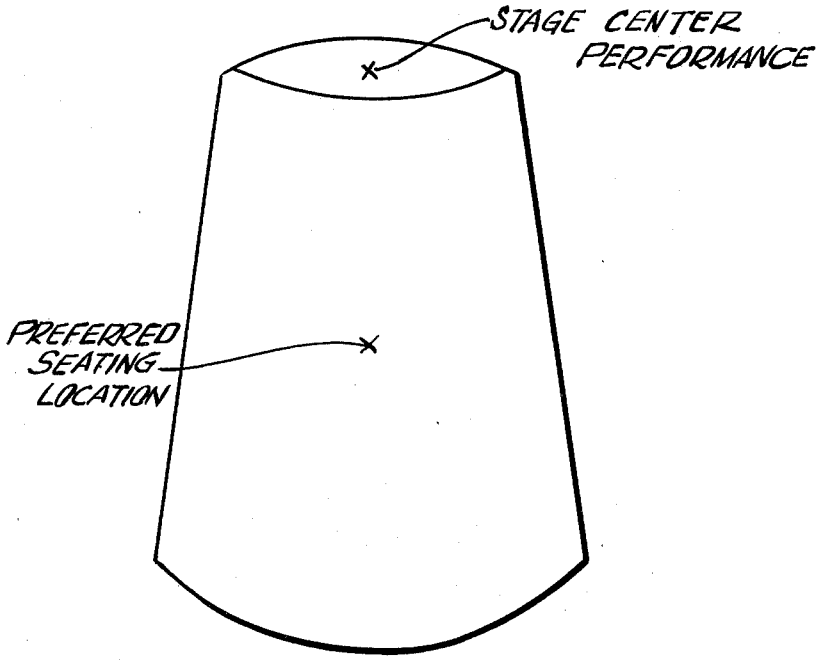
FIG. 6*a* is a Plan for Measurement at a Preferred Seating Location of the Acoustic Environment of a Typical Auditorium on a Stage Center Performance.

FIG. 6*a* indicates a typical environment wherein measurements can be made of the design criteria needed to create a sound enhancement environmental acoustic simulator for a monophonic sound system or a solo musical instrument. The influence of the acoustic environment of a typical auditorium on a stage center performance would be measured at a preferred seating location in the center of the audience.

Figure 6B:
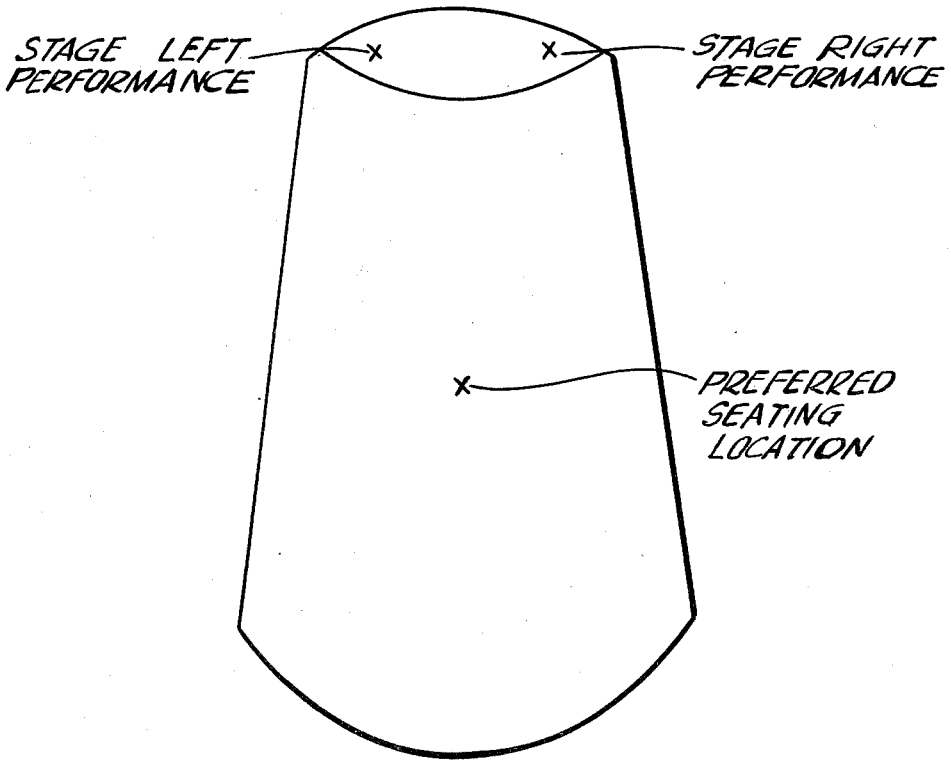
FIG. 6*b* is a Plan for Measurement at a Preferred Seating Location of the Acoustic Environment of a Typical Auditorium on a Stage Left and Stage Right Performance.

FIG. 6*b* indicates for the same typical environment wherein measurements can be made of the design criteria needed to create a sound enhancement environmental acoustic simulator for a stereophonic sound reproduction system. The stage performance source would be placed first at stage left and then at stage right to obtain the influence of the acoustic environment of a typical auditorium on the left channel and right channel inputs as measured at a preferred seating location in the center of the audience.

Figure 7:
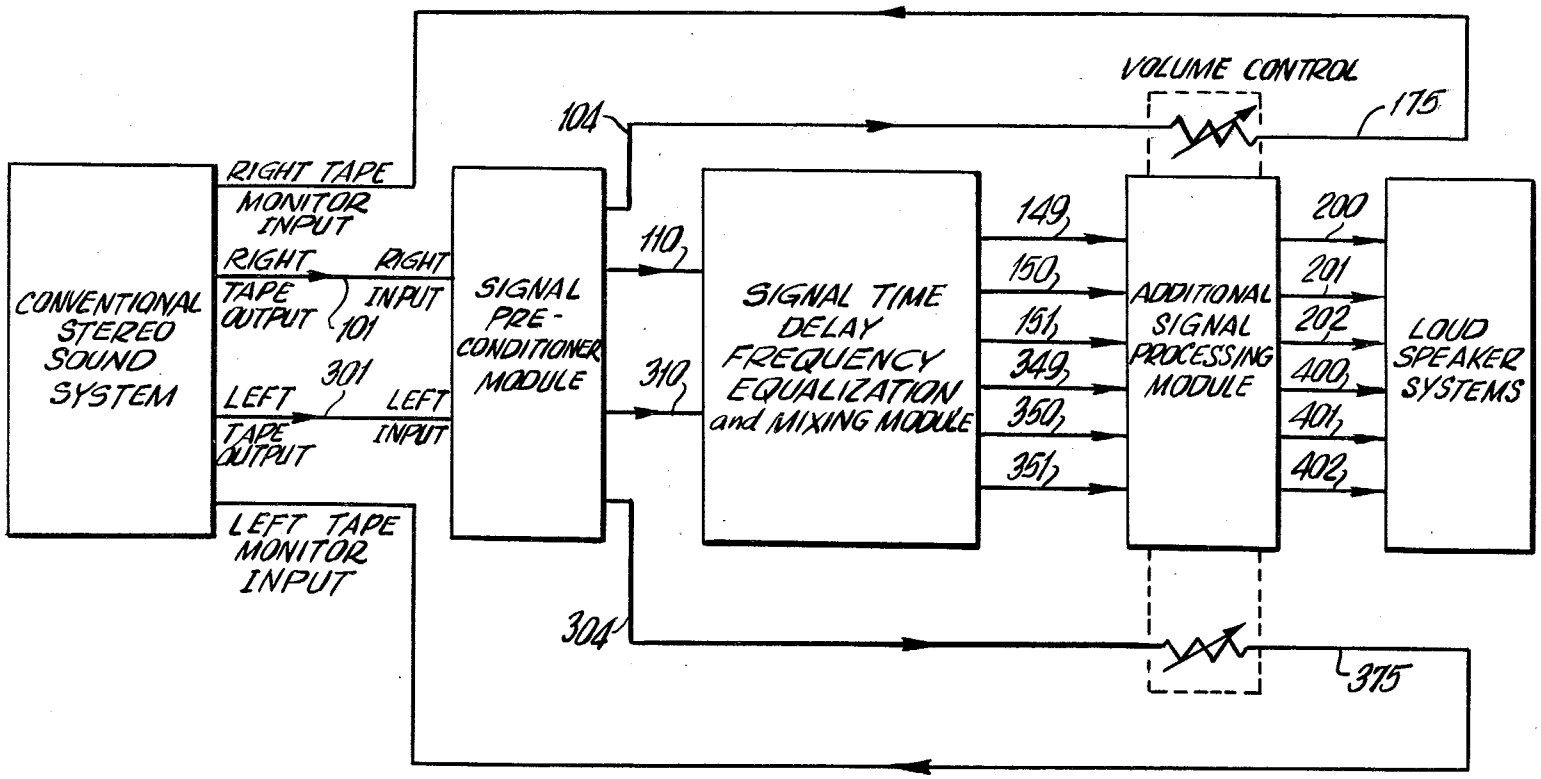
FIG. 7 is a block diagram of a system classified as an Environmental Acoustics Simulator.

With reference to FIG. 7 there is shown in block diagram an implementation of the functional relationships utilized in the electronic environmental acoustic simulator audio system to provide the full dimension and realism to sound reproduction. This audio system is shown with left and right input signals, designated as (301) and (101) respectively, derived from the tape output connections from a conventional stereo sound system. These signals are then processed through the signal preconditioner module, the signal time delay, frequency equalization and mixing module, the additional signal processing module and the loud speaker systems, which emit the enhanced sound energy.

Figure 8A:
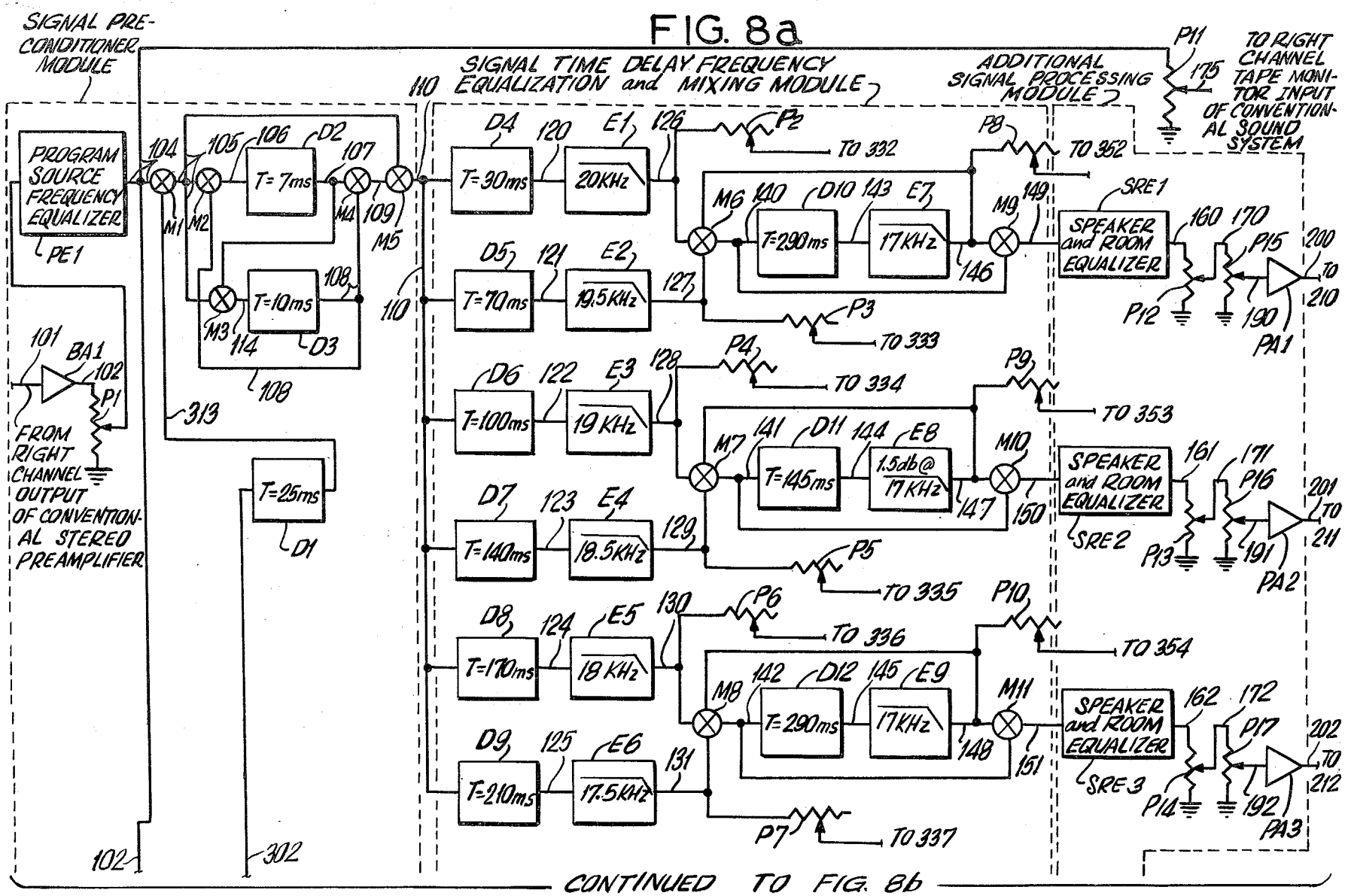
FIGS 8*a* and 8*b* form a detailed circuit diagram of the Preferred Embodiment of the Invention in FIG. 7.
Figure 8B:
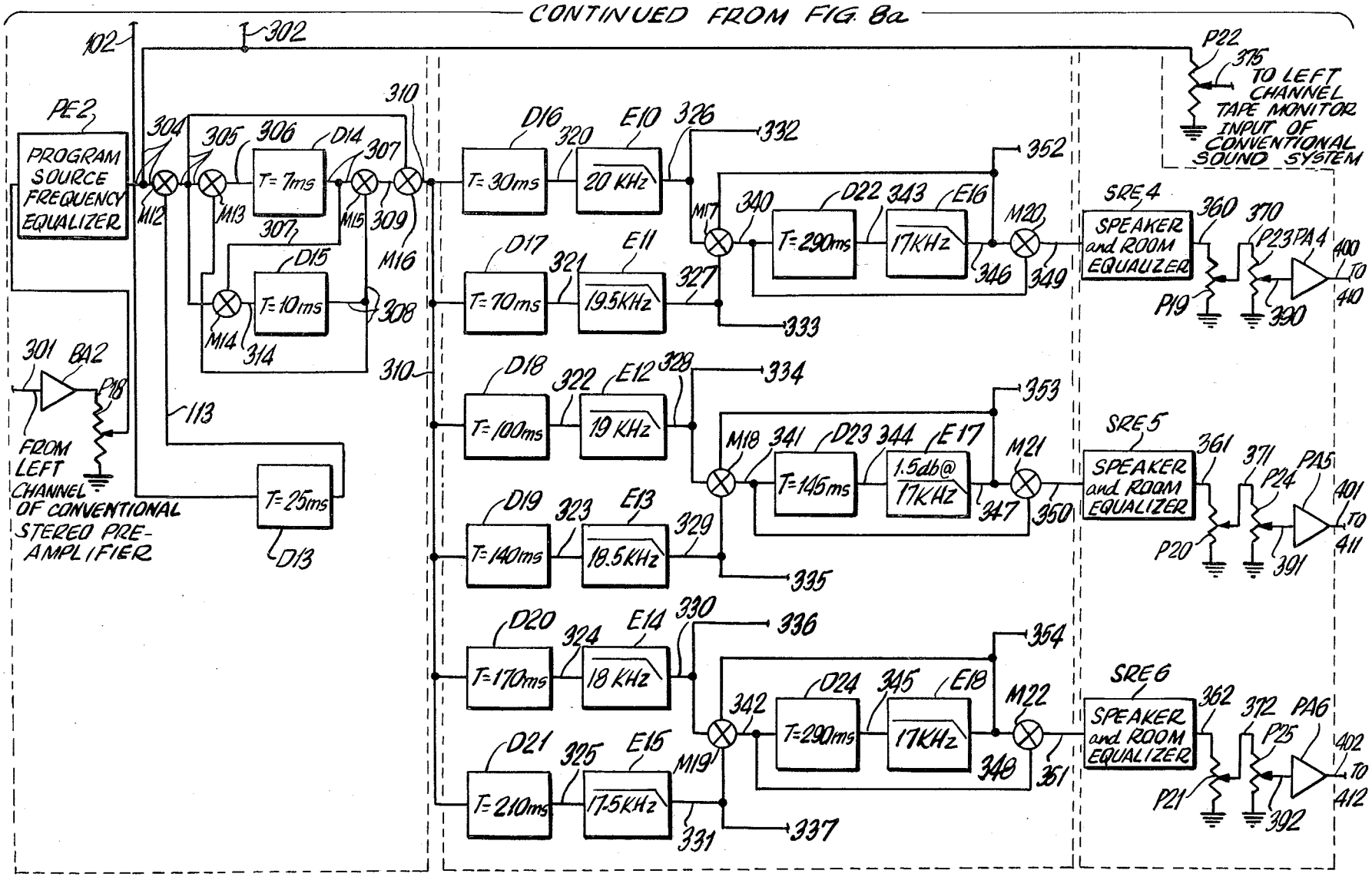

The Detailed Circuit Diagram, FIG. 8, shows these left and right signals, (301) and (101) respectively, applied to buffer amplifiers (BA-1) for the right channel and (BA-2) for the left channel. Their typically high input impedences of 100 k ohms or greater provides good isolation without loading down or otherwise adversely affecting the original inputs. Control potentiometers (P-1) for the right channel and (P-18) for the left channel provide adjustment for signal levels to subsequent circuitry. Frequency response equalizers (PE-1) on the right channel and (PE-2) for the left channel are typically five band equalizers which are used to compensate for variations in tonal balance inherent in different program source signals which may be encountered. Mixers (M-1) for the right channel and (M-12) for the left channel provide for an adjustable mixture of signals at (104) and (304) with corresponding signals of the opposite channels at (313) and (113) respectively, subsequent to a delay of 25 milliseconds provided by time delay units (D-1) and (D-13) respectively. Introduction of 25 millisecond delayed signal from one channel into the other simulates the appearance of sound energy from a source on one side of a performing stage at the other side after elapse of a brief period of time. Adjustment is provided to compensate for the degree to which this delayed signal may be present or absent in different program sources. Construction of time delay devices may take any of several forms well known to those skilled in the art.

A controllable reverberation network for the right channel consists of (M2), (M3), (M4), (M5), (D2) and (D3). A corresponding network for the left channel consists of (M13), (M14), (M15), (M16), (D14) and (D15). These networks provide several closely spaced short delays and may be used to compensate for differences in the amount of reverberation inherent in various program source signals. For the right channel, output of frequency equalizer (PE-1) at (104) is connected to mixer (M1) where it is blended with left channel signal from (313) which is delayed 25 milliseconds by (D1) from (302). Output of mixer (M1) at (105) is applied in parallel to inputs of mixers (M2), (M3) and (M5). Output of mixer (M2) at (106) is applied to 7 millisecond time delay (D2). Output of (D2) at (107) is applied in parallel to mixers (M3) and (M4). Output of mixer (M4) at (109) is applied to input of mixer (M5). Output of mixer (M3) at (114) is applied to input of 10 millisecond time delay (D3). Output of (D3) at (108) is applied in parallel to inputs of mixers (M4) and (M2). For the left channel, output of frequency equalizer (PE-2) at (304) is connected to mixer (M12) where it is blended with right channel signal from (113) having been delayed 25 milliseconds by (D13) from (102). Output of mixer (M12) at (305) is applied in parallel to inputs of mixers (M13), (M14), and (M16). Output of mixer (M13) at (306) is applied to 7 millisecond time delay (D14). Output of (D14) at (307) is applied in parallel to mixers (M15) and (M14). Output of mixer (M15) at (309) is applied to input of mixer (M16). Output of mixer (M14) at (314) is applied to input of 10 millisecond time delay (D15). Output of (D15) at (308) is applied in parallel to inputs of mixers (M15) and (M13).

Signals appearing at outputs (110) of mixer (M5) and (310) of mixer (M16) are each fed to six time delay circuits connected with their inputs in parallel. Thus for the right channel; (D4) of 30 milliseconds, (D5) of 70 milliseconds, (D6) of 100 milliseconds, (D7) of 140 milliseconds, (D8) of 170 milliseconds, and (D9) of 210 milliseconds. A similar arrangement for the left channel signal appearing at (310) is fed in parallel to (D16) of 30 milliseconds, (D17) of 70 milliseconds, (D18) of 100 milliseconds, (D19) of 140 milliseconds, (D20) of 170 milliseconds and (D21) of 210 milliseconds. Outputs of each of these delay units is filtered in such manner that high frequency attenuation is greater for time delays further removed from the original signal. Thus for the right channels; output of 30 millisecond delay at (120) is fed to low pass filter (E1) whose output at (126) is down 3 decibels at 20 kilohertz with respect to its midband response, output of 70 millisecond delay unit at (121) fed to low pass filter (E2) whose output at (127) is down 3 decibels at 19.5 kilohertz, output of 100 millisecond delay at (122) is fed to low pass filter (E3) whose output at (128) is down 3 decibels at 19.0 kilohertz, output of 140 millisecond delay at (123) is fed to low pass filter (E4) whose output at (129) is down 3 decibels at 18.5 kilohertz, output of 170 millisecond delay at (124) is fed to low pass filter (E5) whose output at (130) is down 3 decibels at 18.0 kilohertz, and output of 210 millisecond delay at (125) is fed to low pass filter (E6) whose output at (131) is down 3 decibels at 17.5 kilohertz. Similarly for the left channel; output of 30 millisecond delay at (320) is fed to low pass filter (E10) whose output at (326) is down 3 decibels at 20 kilohertz, output of 70 millisecond delay at (321) is fed to low pass filter (E11) whose output at (327) is down 3 decibels at 19.5 kilohertz, output of 100 millisecond delay at (322) is fed to low pass filter (E12) whose output at (328) is down 3 decibels at 190 kilohertz, output of 140 millisecond delay at (323) is fed to low pass filter (E13) whose output at (329) is down 3 decibels at 18.5 kilohertz, output of 170 millisecond delay at (324) is fed to low pass filter (E14) whose output at (330) is down 3 decibels at 18.0 kilohertz, and output of 210 millisecond delay at (325) is fed to low pass filter (E15) whose output at (331) is down 3 decibels at 17.5 kilohertz.

The foregoing filtered delays are fed to 6 mixers—2 filter outputs per mixer as follows: for the right channels output of (E1) at (126) and of (E2) at (127) are fed to mixer (M6), output of (E3) at (128) and (E4) at (129) are fed to mixer (M7), and output of (E5) at (130) and (E6) at (131) are fed to (M8). Similarly for the left channels, filter output of (E10) at (326) and (E11) at (327) are fed to mixer (M17), output of (E12) at (328) and of (E13) at (329) are fed to mixer (M18) and output of (E14) at (330) and (E15) at (331) are fed to mixer (M19).

In addition, the foregoing filter outputs of the right channels are also connected to potentiometers which are also connected to the corresponding filter outputs of the left channels. Thus (126) is connected to potentiometer (P2) which is connected to (322), (127) is connected to (P3) which is connected to (333), (128) is connected to (P4) which is connected to (334), (129) is connected to (P5) which is connected to (335), (130) is connected to (P6) which is connected to (336) and (131) is connected to (P7) which is connected to (337). The aforementioned potentiometers permit a controlled amount of crossblending of left channel signals to corresponding right channel signals to reflect typically increasing similarity between reverberant fields resultant from sources at stage left and the same sources at stage right with the passage of time. Thus, for proper adjustment, crossblending should be greater for filter outputs corresponding to longer delay times.

Right channels mixer output of (M6) at (140) is fed to 290 millisecond delay (D10), output of mixer (M7) at (141) is fed to 145 millisecond delay (D11), and output of mixer (M8) at (142) is fed to 290 millisecond delay (D12). Similarly for the left channels, output of mixer (M17) at (340) is fed to 290 millisecond delay (D22), output of mixer (M18) at (341) is fed to 145 millisecond delay (D23), and output of mixer (M19) at (342) is fed to 290 millisecond delay (D24).

Outputs of aforementioned delays are fed to low pass filters as follows: for the right channels, the output of (D10) at (143) is fed to low pass filter (E7) which is down 3 decibels at 17 kilohertz, the output of (D11) at (144) is fed to low pass filter (E8) which is down 1.5 decibels at 17 kilohertz, and the output of (D12) at (145) is fed to low pass filter (E9) which is down 3 decibels at 17 kilohertz. Similarly for the left channels: the output of (D22) at (343) is fed to low pass filter (E16) which is down 3 decibels at 17 kilohertz, the output of (D23) at (344) is fed to low pass filter (E17) which is down 1.5 decibels at 17 kilohertz, and the output of (D24) at (345) is fed to low pass filter (E18) which is down 3 decibels at 17 kilohertz.

The outputs of the aforementioned filters are connected as follows; for the right channels, (E7) at (146) is connected in parallel to (M6) to form a recirculation loop and to potentiometer (P8) and to mixer (M9), (E8) at (147) is connected in parallel to (M7) to form a recirculation loop and to potentiometer (P9) and to mixer (M10), and (E9) at (148) is connected in parallel to mixer (M8) to form a recirculation loop and to potentiometer (P10) and to mixer (M11). Similarly for the left channels; (E16) at (346) is connected in parallel to mixer (M17) to form a recirculation loop and to wiper of potentiometer (P8) and to mixer (M20), (E17) at (347) is connected in parallel to mixer (M18) to form a recirculation loop and to wiper of potentiometer. (P9) and to mixer (M21), and (E18) at (348) is connected in parallel to mixer (M19) to form a recirculation loop and to wiper of potentiometer (P10) and to mixer (M22). Potentiometers (P8), (P9), and (P10) serve to crossblend left channel signals with corresponding right channel signals to reflect the typically increasing similarity between reverberant fields resultant from sources at stage left and fields resultant from sources at stage right with the passage of time. The net effect of that aspect of the circuitry whose inputs appear at (110) and (310) and whose outputs appear at (149), (150), (151), (349), (350), and (351), is to derive three right channel signals defined as right front at (149), right side at (150), and right rear at (151), and three left channel signals defined as left front at (349), left side at (350) and left rear at (351). These are derived in such manner that a pulse signal appearing at (110) and (310) will appear to induce fluctuation from front to side to rear to side to front to side, etc., with decreasing amplitude, with relatively decreasing high frequency content and with increasing similarity between corresponding right and left signals with the passage of time. Principal time delays generated by delay circuits (D4), (D5), (D6), (D7), (D8), (D9), (D10), (D11), (D12), (D16), (D17), (D18), (D19), (D20), (D21), (D22), (D23), and (D24) are specified in milliseconds for the first 4 seconds. They do not include secondary delays, i.e. those introduced by (D2), (D3), (D14), and (D15), those created by the delayed crosschannel feeding introduced by (D1) and (D13), those inherent in the recordings themselves, or those introduced by the acoustic environment in which the simulator is installed. The attenuation at 17 kilohertz introduced exclusively by filters (E7), (E8), (E9), (E16), (E17), and (E18) is given. Since each corresponding right and left channel introduce the same delays, the time delays shown are specified for the right only and are segregated into front, side and rear.

| FRONT | | SIDE | | REAR | |
|---|---|---|---|---|---|
| Time Delay (ms.) | Attenuation (−db @17khz) | Time Delay (ms.) | Attenuation (−db @17khz) | Time Delay (ms.) | Attenuation (−db @17khz) |
| 30 | 0 | | | | |
| 70 | 0 | | | | |
| | | 100 | 0 | | |
| | | 140 | 0 | | |
| | | | | 170 | 0 |
| | | | | 210 | 0 |
| | | 245 | 1½ | | |
| | | 285 | 1½ | | |
| 320 | 3 | | | | |
| 360 | 3 | | | | |
| | | 390 | 3 | | |
| | | 430 | 3 | | |
| | | | | 460 | 3 |
| | | | | 500 | 3 |
| | | 535 | 4½ | | |
| | | 575 | 4½ | | |
| 610 | 6 | | | | |
| 650 | 6 | | | | |
| | | 680 | 6 | | |
| | | 720 | 6 | | |
| | | | | 750 | 6 |
| | | | | 790 | 6 |
| | | 825 | 7½ | | |

-continued

| FRONT | | SIDE | | REAR | |
|---|---|---|---|---|---|
| Time Delay (ms.) | Attenuation (−db @17khz) | Time Delay (ms.) | Attenuation (−db @17khz) | Time Delay (ms.) | Attenuation (−db @17khz) |
| | | 865 | 7½ | | |
| 900 | 9 | | | | |
| 940 | 9 | | | | |
| | | 970 | 9 | | |
| | | 1010 | 9 | | |
| | | | | 1040 | 9 |
| | | | | 1080 | 9 |
| | | 1115 | 10½ | | |
| | | 1155 | 10½ | | |
| 1190 | 12 | | | | |
| 1230 | 12 | | | | |
| | | 1260 | 12 | | |
| | | 1300 | 12 | | |
| | | | | 1330 | 12 |
| | | | | 1370 | 12 |
| | | 1405 | 13½ | | |
| | | 1445 | 13½ | | |
| 1480 | 15 | | | | |
| 1520 | 15 | | | | |
| | | 1550 | 15 | | |
| | | 1590 | 15 | | |
| | | | | 1620 | 15 |
| | | | | 1660 | 15 |
| | | 1695 | 16½ | | |
| | | 1735 | 16½ | | |
| 1770 | 18 | | | | |
| 1810 | 18 | | | | |
| | | 1840 | 18 | | |
| | | 1880 | 18 | | |
| | | | | 1910 | 18 |
| | | | | 1950 | 18 |
| | | 1985 | 19½ | | |
| | | 2025 | 19½ | | |
| 2060 | 21 | | | | |
| 2100 | 21 | | | | |
| | | 2130 | 21 | | |
| | | 2170 | 21 | | |
| | | | | 2200 | 21 |
| | | | | 2240 | 21 |
| | | 2275 | 22½ | | |
| | | 2315 | 22½ | | |
| 2350 | 24 | | | | |
| 2390 | 24 | | | | |
| | | 2420 | 24 | | |
| | | 2469 | 24 | | |
| | | | | 2490 | 24 |
| | | | | 2530 | 24 |
| | | 2565 | 25½ | | |
| | | 2605 | 25½ | | |
| 2640 | 27 | | | | |
| 2680 | 27 | | | | |
| | | 2710 | 27 | | |
| | | 2750 | 27 | | |
| | | | | 2780 | 27 |
| | | | | 2820 | 27 |
| | | 2855 | 28½ | | |
| | | 2895 | 28½ | | |
| 2930 | 30 | | | | |
| 2970 | 30 | | | | |
| | | 3000 | 30 | | |
| | | 3040 | 30 | | |
| | | | | 3070 | 30 |
| | | | | 3110 | 30 |
| | | 3145 | 31½ | | |
| | | 3185 | 31½ | | |
| 3220 | 33 | | | | |
| 3260 | 33 | | | | |
| | | 3290 | 33 | | |
| | | 3330 | 33 | | |
| | | | | 3360 | 33 |
| | | | | 3400 | 33 |
| | | 3435 | 34½ | | |
| | | 3475 | 34½ | | |
| 3510 | 36 | | | | |
| 3550 | 36 | | | | |
| | | 3580 | 36 | | |
| | | 3620 | 36 | | |
| | | | | 3650 | 36 |

-continued

| FRONT | | SIDE | | REAR | |
|---|---|---|---|---|---|
| Time Delay (ms.) | Attenuation (−db @17khz) | Time Delay (ms.) | Attenuation (−db @17khz) | Time Delay (ms.) | Attenuation (−db @17khz) |
| | | | | 3690 | 36 |
| | | 3725 | 37½ | | |
| | | 3765 | 37½ | | |
| 3800 | 39 | | | | |
| 3840 | 39 | | | | |
| | | 3870 | 39 | | |
| | | 3910 | 39 | | |
| | | | | 3940 | 39 |
| | | | | 3980 | 39 |

Mixer outputs at (149), (150), (151), (349), (350), and (351) are each fed to a speaker and room equalizer which can be adjusted to compensate for the spectral characteristics of the loudspeaker systems in the environment in which they are installed. Typically, these are ten band equalizers whose design and construction is well known to those skilled in the art. The mixer output appearing at (149) is fed to equalizer (SRE1), mixer output at (150) is fed to equalizer (SRE2), mixer output at (151) is fed to equalizer (SRE3), mixer output appearing at (349) is fed to equalizer (SRE4), mixer output appearing at (350) is fed to equalizer (SRE5), and mixer output appearing at (351) is fed to equalizer (SRE6). The output of each of the aforementioned equalizers is applied to one section of a multisection potentiometer which is used to simultaneously control the signal levels fed to all of the ensuing circuitry as well as the signal level returned to the conventional stereo sound system. Thus, by means of a single mechanical potentiometer shaft or slider, adjustment may be made to the gain of both the entire simulator output and that of the conventional stereo sound system. Output of (SRE1) at (160) is applied to one leg of potentiometer (P12), output of (SRE2) at (161) is applied to one leg of (P13), output of (SRE3) at (162) is applied to one leg of (P14), output of (SRE4) at (360) is applied to one leg of (P19), output of (SRE5) at (361) is applied to one leg of (P20) and output of (SRE6) at (362) is applied to one leg of (P21). In addition, (104) is connected to one leg of (P11) and (304) is connected to one leg of (P22). Each of the remaining legs of (P11), (P12), (P13), (P14), (P19), (P20), (P21) and (P22) is connected to ground. (P11), (P12), (P13), (P14), (P19), (P20), (P21) and (P22) are operated by the same mechanical actuator. The wipers of (P11) at (175) and (P22) at (375) are then made available for connection to the tape monitor inputs of the right and left channels respectively of the conventional stereo amplifier or receiver. The wipers of potentiometers (P12), (P13), (P14), (P19), (P20), and (P21) are each connected to one leg of another potentiometer which facilitates individual adjustment of the signal fed to each of the ensuing amplifiers. Thus, the wiper of potentiometer (P12) at (170) is connected to (P15), the wiper of (P13) at (171) is connected to (P16), the wiper of (P14) at (172) is connected to (P17), the wiper of (P19) at (370) is connected to (P23), the wiper of (P20) at (371) is connected to (P24), and the wiper of (P21) at (372) is connected to (P25). Each of the remaining legs of (P15), (P16), (P17), (P23), (P24) and (P25) is connected to ground. Each wiper of potentiometers (P15), (P16), (P17), (P23), (P24), and (P25) is connected to the input of a power amplifier. Thus the wiper of (P15) at (190) is connected to the input of power amplifier (PA1), the wiper of (P16) at (191) is connected to the input of (PA2), the wiper of (P17) at (192) is connected to the input of (PA3), the wiper of (P23) at (390) is connected to the input of (PA4), the wiper of (P24) at (391) is connected to the input of (PA5), and the wiper of (P25) at (392) is connected to the input of (PA6). Power amplifiers (PA1), (PA2), (PA3), (PA4), (PA5), and (PA6) are typically high fidelity amplifiers having power output capabilities of 30 watts each and are stable with loads of 4 ohms or greater. They have internal filtering of signals outside of the audio passband of 20 hertz to 20 kilohertz.

Each of the six high fidelity amplifiers is connected to six loudspeakers described as a speaker bank or group. There are thirty-six loudspeakers in all. Two loudspeakers are mounted in each enclosure such that there are three enclosures per bank. The loudness of each pair of speakers in each enclosure is controlled by a 16 ohm, 10 watt, L-pad. The loudspeakers are typically 4 inch diameter, 8 ohm, full range acoustic suspension high fidelity speakers typically wired in a series/parallel arrangement and those in the same enclosure are in series and electrically out of phase with one another. They are mounted in enclosures in such manner that they radiate their energy indirectly into the environment. Thus they are described as Loudspeakers in Direction Controlled Enclosures. Their radiation directly at the listener is restricted to create a diffuse sound field typical of fine auditoriums such that the source of the individual drivers is not detectable by aural directional cues. This method also maximizes the optimal listening area. Typical mounting locations are at the periphery of the room and two or more feet from the ceiling with the drivers' axes pointing at the ceiling and nearby walls in order to take full advantage of the reflective properties of the boundary structures comprising the environment. The front right bank is defined as comprising speakers (S1), (S2), (S3), (S4), (S5), and (S6), and the front left bank is defined as comprising speakers (S19), (S20), (S21), (S22), (S23), and (S24). They are placed near room boundaries nearest the conventional stereo speaker systems. These include the front wall and the side walls near the front wall. Left and right are defined in the same sense as for the conventional stereo system. One enclosure in the left front bank and one enclosure in the right front bank are located near the level of the speakers of the conventional stereo sound system which should be placed from 2 to 4 feet from the floor. The arrangement simulates the fact that early delays in a fine auditorium arrive from physical structures close to the sources and adds a subjective sense of breadth and depth to the sources. The right rear speaker bank comprises (S13), (S14), (S15), (S16), (S17), and (S18) and the left rear bank comprises (S31), (S32), (S33), (S34), (S35), and (S36). They are placed two or more feet from the ceiling near the surface boundaries farthest from the conventional stereo speakers. These include the rear wall and the side walls nearest the rear wall. The side right speaker bank comprises (S7), (S8), (S9), (S10), (S11), and (S12), and the side left speaker bank comprises (S25), (S26), (S27), (S28), (S29) and (S30). They are mounted on the side walls two or more feet from the ceiling filling the space between the front and rear speaker banks. Corresponding left and right banks are placed symmetrically. They are positioned such that each left enclosure is out of phase with its opposite on the right. The speakers within each bank are positioned such that each driver is out of phase with the one adjacent to it. The objective of the speaker enclosure design and placement is the creation of a sound field which is as diffuse and uniform as possible which is also the stated objective of many acoustic architects when designing auditoriums.

Figure 9A:
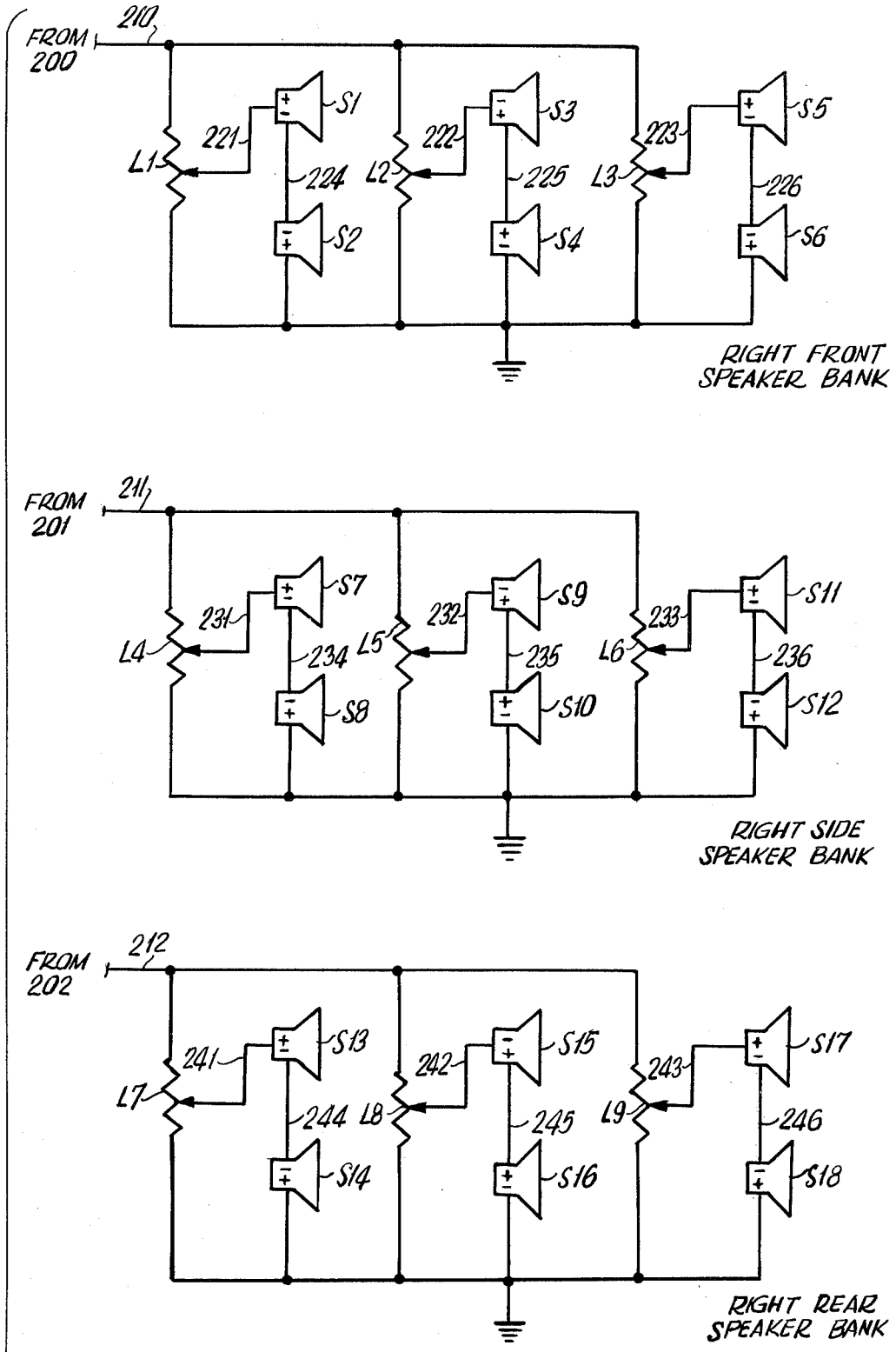
FIG. 9*a* is the Right Speaker Banks Circuit Diagrams.

With reference to FIG. 9*a* there is shown a circuit diagram of the right speaker banks. Output of power amplifier (PA1) at (200) on diagram 8 is shown as (210). This is connected in parallel to three L-pads (L1), (L2) and (L3). The other leg of each of the L-pads is connected to ground. Wiper connection (221) of (L1) is connected to the positive terminal of speaker (S1). The negative terminal of (S1) is connected at (224) to the negative terminal of speaker (S2). The positive terminal of (S2) is connected to ground. The wiper connection of (L2) at (222) is connected to the negative terminal of (S3). The positive terminal of (S3) is connected to the positive terminal of (S4). The negative terminal of (S4) is connected to ground. The wiper terminal of (L3) is connected at (223) to the positive terminal of (S5) at (226). The negative terminal of (S5) is connected to the negative terminal of (S6). The positive terminal of (S6) is connected to ground.

Output of power amplifier (PA2) at (211) is shown on diagram 8 as (201). This is connected in parallel to three L-pads (L4), (L5), and (L6). The other leg of each of the L-pads is connected to ground. Wiper connection (231) of (L4) is connected to the positive terminal of (S7). The negative terminal of (S7) is connected at (234) to the negative terminal of speaker (S8). The positive terminal of (S8) is connected to ground. Wiper connection of (L5) at (232) is connected to the negative terminal of (S9). The positive terminal of (S9) at (235) is connected to the positive terminal of (S10). The negative terminal of (S10) is connected to ground. Wiper connection of (L6) at (233) is connected to the positive terminal of (L11). The negative terminal of (S11) at (236) is connected to the negative terminal of (S12). The positive terminal of (S12) is connected to ground.

Output of power amplifier (PA3) at (212) is shown on diagram 8 as (202). This is connected in parallel to three L-pads (L7), (L8), and (L9). The other leg of each of the L-pads is connected to ground. Wiper connection (241) of (L7) is connected to the positive terminal of (S13). The negative terminal of (S13) is connected at (244) to the negative terminal of (S14). The positive terminal of (S14) is connected to ground. Wiper connection of (L8) at (242) is connected to the negative terminal of (S15). The positive terminal of (S15) at (245) is connected to the positive terminal of (S16). The negative terminal of (S16) is connected to ground. Wiper connection of (L9) at (243) is connected to the positive terminal of (S17). The negative terminal of (S17) at (246) is connected to the negative terminal of (S18). The positive terminal of (S18) is connected to ground.

Figure 9B:
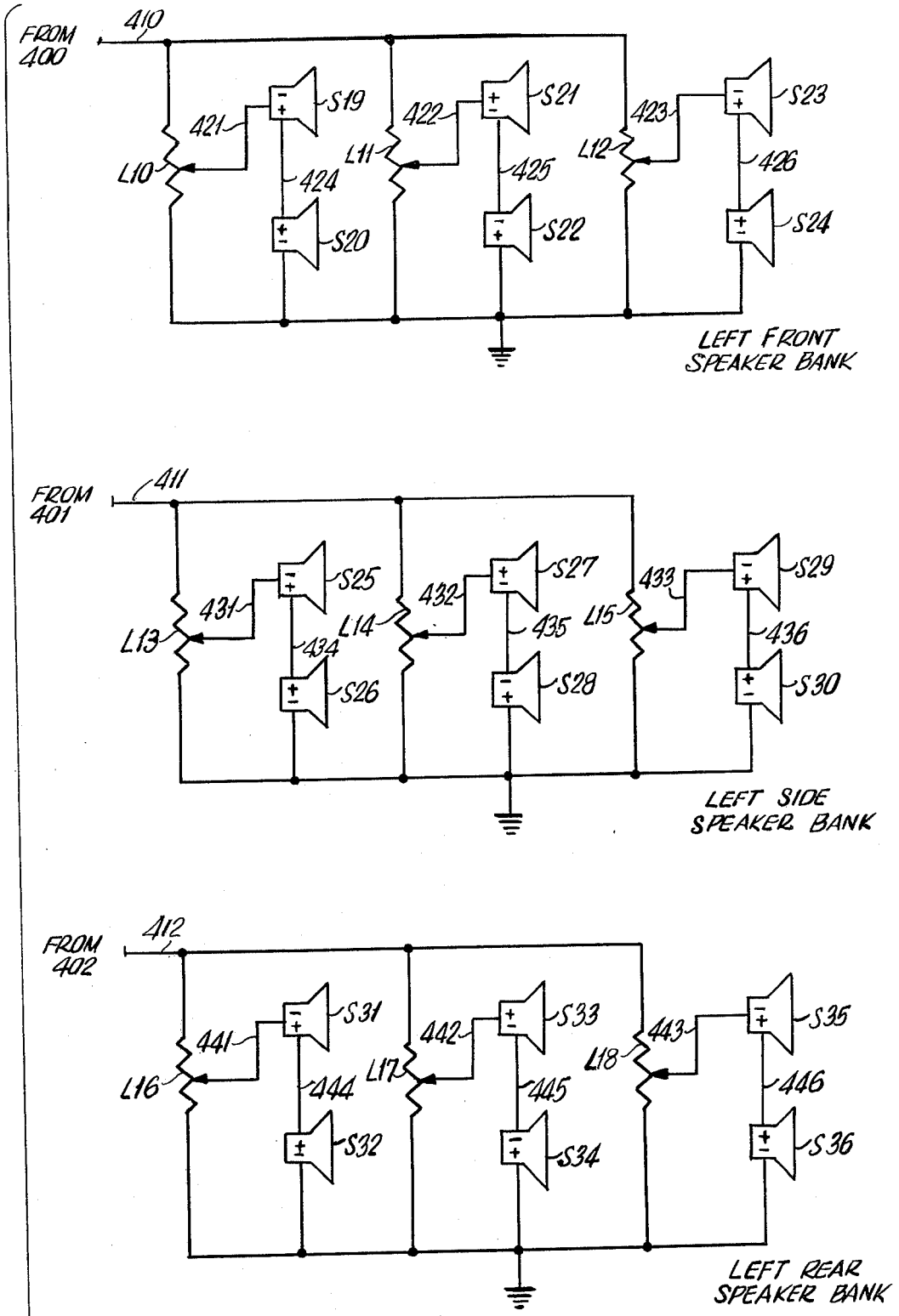
FIG. 9*b* is the Left Speaker Banks Circuit Diagrams.

With reference to FIG. 9*b* there is shown a circuit diagram of the left speaker banks. Output of power amplifier (PA4) at (400) on FIG. 8 is shown as (410). This is connected in parallel to three L-pads (L10), (L11), and (L12). The other leg of each of the L-pads is connected to ground. Wiper connection of (L10) at (421) is connected to the negative terminal of (S19). The positive terminal of (S19) at (424) is connected to the positive terminal of (S20). The negative terminal of (S20) is connected to ground. Wiper connection of (L11) at (422) is connected to the positive terminal of (S21). The negative terminal of (S21) at (425) is connected to the negative terminal of (S22). The positive terminal of (S22) is connected to ground. Wiper connection of (L12) at (423) is connected to the negative terminal of (S23). The positive terminal of (S23) at (426) is connected to the positive terminal of (S24). The negative terminal of (S24) is connected to ground.

Output of power amplifier (PA5) at (411) is shown as (401) on FIG. 8. It is connected in parallel to three L-pads, (L13), (L14), and (L15). The other leg of each of the L-pads is connected to ground. Wiper connection of (L13) at (431) is connected to the negative terminal of (S25). The positive terminal of (S25) at (434) is connected to the positive terminal of (S26). The negative terminal of (S26) is connected to ground. Wiper connection of (L14) at (432) is connected to the positive terminal of (S27). The negative terminal of (S27) is connected at (435) to the negative terminal of (S28). The positive terminal of (S28) is connected to ground. Wiper connection of (L15) at (433) is connected to the negative terminal of (S29). The positive terminal of (S29) at (436) is connected to the positive terminal of (S30). The negative terminal of (S30) is connected to ground.

Output of power amplifier (PA6) at (412) is shown as (402) on FIG. 8. It is connected in parallel to three L-pads (L16), (L17), and (L18). The other leg of each L-pad is connected to ground. Wiper connection of (L16) at (441) is connected to the negative terminal of (S31). The positive terminal of (S31) at (444) is connected to the positive terminal of (S32). The negative terminal of (S32) is connected to ground. Wiper connection of (L17) at (442) is connected to the positive terminal (S33). The negative terminal of (S33) at (445) is connected to the negative terminal of (S34). The positive terminal of (S34) is connected to ground. Wiper connection of (L18) at (443) is connected to the negative terminal of (S35). The positive terminal of (S35) at (446) is connected to the positive terminal of (S36). The negative terminal of (S36) is connected to ground.

Figure 10:
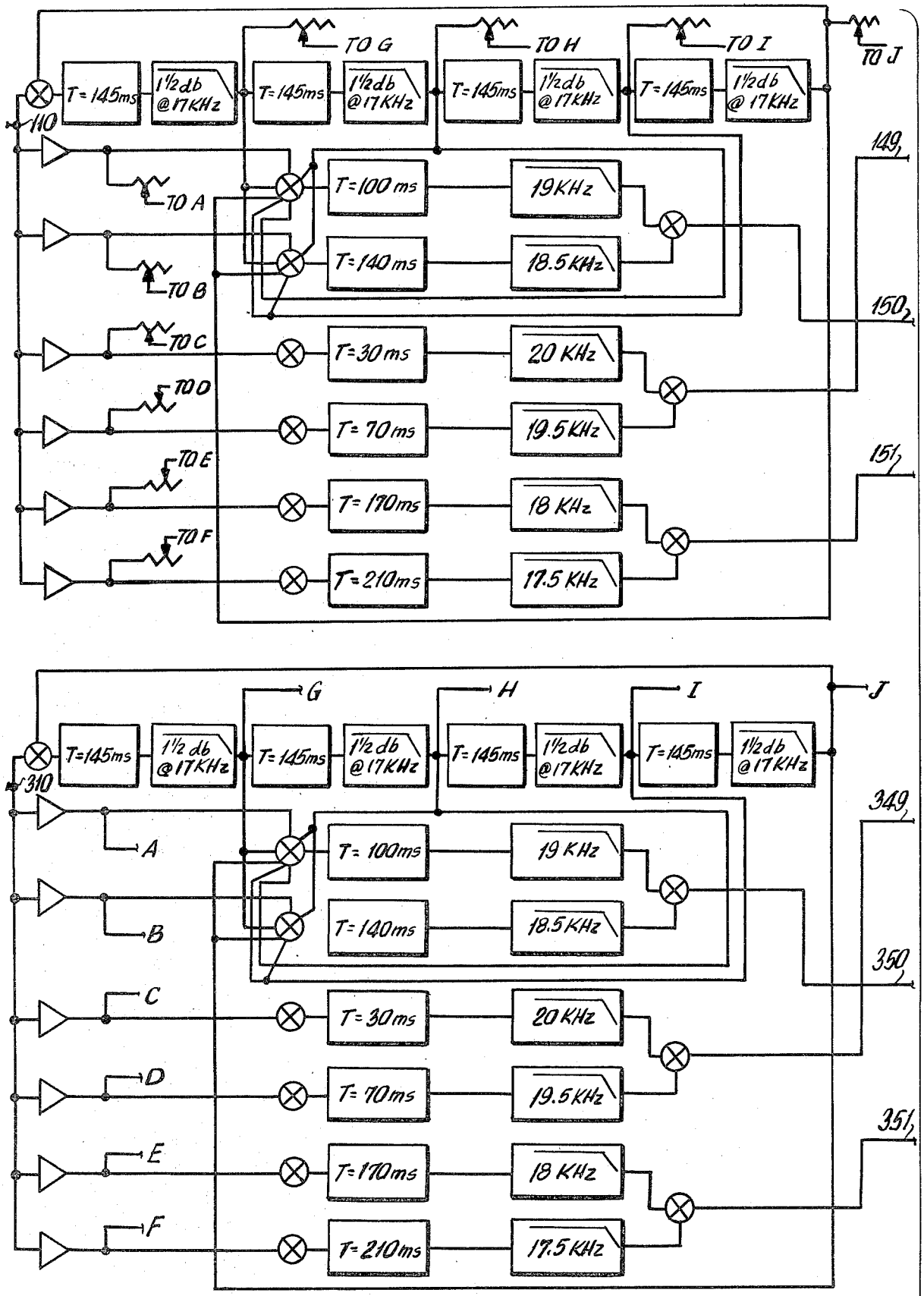
FIG. 10 is an Alternate Embodiment of Part of the Detailed Circuit Shown in FIGS. 8*a* and 8*b*.

With reference to FIG. 10 there is shown an alternate embodiment of the circuitry of the module which provides the necessary signal time delays, frequency equalizations and mixing to realize the transformation between (110) and (310) and (149), (150), (151), (349), (350), and (351). This circuit gives results similar to that of the corresponding module circuitry in FIG. 8. Its principal advantage lies in the increased stability of operation due to its use of one recirculation loop for the left channel and one for the right channel as opposed to three for the left and three for the right shown for the module in FIG. 8. In addition, any variations in the loop gain affect all of the outputs in a related manner making such fluctuations less objectionable.

The circuitry and arrangements shown does not include various additions and modifications or alternatives familiar to those versed in the art. One example of an addition would be the inclusion of a peak limiter which may be frequency selective in its action to eliminate the effects of explosive transients inherent in some program source signals. An example of a modification would be the incorporation of adjustable multiband equalizers in place of the fixed filters and the incorporation of adjustable time delays and mixers all in sufficient number that the precise operating parameters could be changed at will to simulate different environments for whose acoustical relationships, data has been made available. One example of an alternative is the use of full range electrostatic or magnetoplanar loudspeakers whose large sound producing surfaces are capable of creating diffuse sound fields when used as direct radiators.

The environmental acoustic simulator restores the sense of power to the sound source that was lost in the unenhanced or poorly enhanced playback as well as the sense of space. Also, the nonlinear nature of the simulator will enhance the dynamics of music.

The foregoing is considered illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention as claimed:

What we claim is:

1. A sound reproduction system for a listening area classified as an environmental acoustic simulator providing enhancement of left and right stereophonic signal sources from a conventional stereo sound system which are delayed, equalized and mixed in certain combinations to form six channels and then further mixed, equalized and amplified to drive 36 loudspeakers in 18 loudspeaker enclosures, said system comprising;

(a) the signal preconditioner module comprised of two identical submodules designated left and right deriving their input signals from the respective left and right preamplifier tape outputs, main preamplifier outputs or the like of the left and right stereophonic signal sources of a conventional stereo sound system, said submodules comprised of high input impedence buffer amplifiers, control potentiometers for signal level adjustment, adjustable frequency response equalizer means to compensate for variations in the tonal balance of the source signals, time delay units to provide a 25 millisecond delayed signal from one channel into the other, mixers to provide means for an adjustable mixture of signals with corresponding signals of the opposite channel, a controlled reverberation network consisting of means for time delay, mixers and potentiometers providing signal delays of 7 milliseconds, 10 milliseconds and their additive combinations generating the respective left and right output signals for the signal time delay frequency equalization and mixing module, said preconditioner module also providing left and right equalized but undelayed outputs controllable by potentiometers optionally connected to the tape monitor input of the preamplifier of the conventional stereo sound system or to the main power amplifier inputs of the conventional stereo sound system, said potentiometers being mechanically controlled by the same actuator shaft which simultaneously controls the overall gain of the simulator output;

(b) the signal time delay frequency equalization and mixing module comprised of two identical submodules designated left and right deriving their inputs from the respective left and right outputs of the signal preconditioner module, said submodules comprising multiple time delay means providing delays of 30 milliseconds, 70 milliseconds, 100 milliseconds, 140 milliseconds, 170 milliseconds and 210 milliseconds, multiple frequency equalization means providing 3 decibels of attenuation with respect to the midfrequency region at 20 Kilohertz, 19.5 Kilohertz, 19 Kilohertz, 18.5 Kilohertz, 18 Kilohertz and 17.5 Kilohertz, respectively, additional multiple mixers and time delay means providing delays of 145 milliseconds and 290 milliseconds to create in total time delays from both the left and right submodule of up to 4,000 milliseconds, multiple equalization means providing $1\frac{1}{2}$ and 3 db of attenuation at 17 Kilohertz with respect to the midfrequency region, additional mixers and potentiometers providing means to controllably recirculate and crossblend between submodules, their signals from the corresponding left and right channels, there being generated a total of six outputs from the submodules designated as left front, left side, left rear, right front, right side, and right rear for connection to the additional signal processing module;

(c) additional signal processing module consisting of six identical submodules designated as left front, left side, left rear, right front, right side, and right rear, each deriving its input from the corresponding output of the signal delay, frequency equalization and mixing module, each submodule comprising an adjustable frequency equalizer, 2 volume control potentiometers and a high fidelity audio amplifier generating six outputs designated as left front, left side, left rear, right front, right side, right rear suitable for driving the loud speaker systems;

(d) the loudspeaker system comprised of six identical speaker banks designated left front, left side, left rear, right front, right side and right rear, each bank energized by the output of the corresponding additional signal pocessing submodule, each bank comprising three loudspeaker enclosures, each enclosure containing typically 4 inch diameter, 8 ohm full range acoustic suspension high fidelity speakers, wherein two loudspeakers are mounted in series and electrically out of phase in each enclosure to radiate their energy indirectly into the environment, the loudness of each pair of speakers in each enclosure controlled by a 16 ohm, 10 watt, L-pad, three (3) enclosures per speaker bank or group, each of the speaker banks two or more feet from the ceiling with the drivers' axes pointing at the ceiling and nearby walls to take full advantage of the reflective properties of the boundary structure, with one enclosure in the left front bank and one enclosure in the right front bank located near the level of the speakers of the conventional stereo sound system which should be placed from 2 to 4 feet from the floor to simulate early delays arriving close to source, with left and right corresponding banks placed symmetrically and positioned such that each left enclosure is out of phase with its opposite on the right and the speakers within each bank are positioned such that each driver is out of phase with the one adjacent to it.

2. The sound reproduction system of claim 1 comprised of speaker banks which derive three right channel signals defined as right front, right side, right rear and three left channel signals defined as left front, left side, left rear in such a manner that a pulse signal will appear to induce fluctuation from front to side to rear to side to front to side, etc. with decreasing amplitude, with relatively decreasing high frequency content and with increasing similarity between corresponding right and left signals with the passage of time.

3. The system of claim 1 with time delay means to produce a minimum of 45 primary delays over the initial time period of not less than 2000 milliseconds to incoming electrical signals and produce a minimum of 90 primary delays over the extended time period of 4000 milliseconds to incoming electrical signals, comprising delays independent of frequency with gain constant with time and electrically separate from the undelayed signals, with linear circuitry maintained throughout providing acceptable levels of noise and distortion and wide band width.

* * * * *